US006575884B1

(12) United States Patent
Eazor

(10) Patent No.: US 6,575,884 B1
(45) Date of Patent: Jun. 10, 2003

(54) ABDOMINAL EXERCISE MACHINE

(76) Inventor: Robert C. Eazor, 3885 Brookside Dr., Murrysville, PA (US) 15668

( * ) Notice: Subject to any disclaimer, the term of this patent is extended or adjusted under 35 U.S.C. 154(b) by 0 days.

(21) Appl. No.: 09/626,869

(22) Filed: Jul. 27, 2000

Related U.S. Application Data

(60) Provisional application No. 60/145,647, filed on Jul. 27, 1999.

(51) Int. Cl.[7] ..... A63B 26/00; A63B 71/00

(52) U.S. Cl. ..... 482/140; 482/142

(58) Field of Search ..... 482/72, 126, 129, 482/140; 782/121–130, 142, 148, 95, 100

(56) References Cited

U.S. PATENT DOCUMENTS

| | | | | |
|---|---|---|---|---|
| 2,895,736 A | | 7/1959 | Adler et al. | 272/58 |
| 5,120,052 A | | 6/1992 | Evans | 482/145 |
| 5,256,126 A | | 10/1993 | Grotsein | 482/142 |
| 5,580,339 A | * | 12/1996 | Chen | 482/95 |
| 5,580,340 A | * | 12/1996 | Yu | 482/96 |
| 5,672,144 A | | 9/1997 | Hulme | 482/140 |
| 6,120,419 A | * | 9/2000 | Huang | 482/96 |
| 6,340,342 B1 | * | 1/2002 | Lee | 482/142 |

* cited by examiner

*Primary Examiner*—Jerome W. Donnelly
*Assistant Examiner*—Lori Baker Amerson
(74) *Attorney, Agent, or Firm*—Webb Ziesenheim Logsdon Orkin & Hanson, P.C.

(57) ABSTRACT

An apparatus is provided for specifically exercising the lower abdominal muscles, upper abdominal muscles, or both the lower and upper abdominal muscles together in combination of a human user. The apparatus includes a frame which accommodates the upper torso of a user and a resistance member pivotally connected to the frame on a latitudinal axis. The resistance member is capable of pivotal rotation about the axis, and includes a mechanism for varying the resistance of such pivotal rotation. As such, the knees of the user can be raised and lowered above horizontal without interference.

21 Claims, 9 Drawing Sheets

ABDOMINAL EXERCISE MACHINE

The present application claims priority to U.S. Provisional Application Serial No. 60/145,647, filed Jul. 27, 1999.

BACKGROUND OF THE INVENTION

1. Field of the Invention

This invention relates to an exercising device designed to specifically exercise either separately or together both the upper and lower abdominal muscles of a human being and, more particularly, to a design which allows for the isolation of the lower abdominal muscles while simultaneously providing adequate support for the back to allow the user to focus exclusively upon the lower abdominal muscles during exercise.

2. Description of the Prior Art

Exercise apparatus of the type having a bench and sturdy adjustable support assembly designed to permit the user to focus or isolate exercise on one muscle group during use is generally well-known in the art. Depending on the particular design, these apparatuses may be used alone to perform a series of related, focused exercises or to interrelate with other pieces of equipment upon which a variety of exercises may be performed. Examples of such equipment include the bench press designed to allow the user to focus on his/her arms, shoulders, and chest and the leg extension/curl bench designed to allow the user to focus on his/her legs.

Exercise equipment designed to specifically focus or isolate the abdominal muscles is also well-known in the art. However, such equipment does not provide for isolated exercising of the lower abdominal muscles or for adequate support to the lower back during such exercise. Additionally, no apparatus configured in the bench/adjustable frame arrangement allows for exercise of both the lower abdominal muscles in isolation and in combination with the upper abdominal muscles. Further, much of the equipment designed to focus exercise effort on the abdominal muscles incorporates the weight of the user as resistance and cannot, therefore, be adjusted for incorporation into a resistance training program.

Examples of the apparatus designed to specifically focus on the abdominal area include Adler, U.S. Pat. No. 2,895,736; Evans, U.S. Pat. No. 5,120,052; Grotstein, U.S. Pat. No. 5,256,126; and Hulme, U.S. Pat. No. 5,672,144. Notably, each of these devices, however adjustable, fixes the position of the user's knees during use and requires that the user exert effort to pivot his torso toward that fixed position to execute the exercise.

SUMMARY OF THE INVENTION

An apparatus is provided for specifically exercising the lower abdominal muscles, upper abdominal muscles, or both the lower and upper abdominal muscles together in combination of a human user. The apparatus includes a frame which accommodates the upper torso of a user, and a resistance member pivotally connected to the frame on a latitudinal axis. The resistance member is capable of pivotal rotation about the axis and includes means for varying the resistance of such pivotal rotation. As such, the knees of the user can be raised and lowered above horizontal without interference.

The frame may further be supported by a supporting member. Also, a platform may be attached to the supporting member for supporting the user. Such a platform may include a seat portion fixedly attached to one end of the supporting member at a position adjacent the resistance member, as well as a back support portion attached to the support member at a position adjacent the frame. The back support portion may be pivotally connected to the supporting member on a latitudinal axis thereof located immediately adjacent the seat portion. As such, the user can rotate the back support portion above horizontal without interference, thereby exercising the upper abdominal muscles.

The resistance member may be connected to the frame or the support member, and can be connected at one side or both sides thereof.

In a further embodiment, the apparatus includes a supporting member sturdy enough to support an individual during vigorous exercise. Attached to the supporting member is a two-part adjustable articulated bench having sufficient padding for safe exercise. The bench is designed such that in one position, both parts are adjacent one another horizontal and parallel to the surface upon which the frame sits. A seat member portion of the bench is affixed to the aforementioned frame and is of sufficient dimension so that an individual can comfortably sit upon it during use. The seat member has a slot along the center longitudinal axis of the bench to allow for the pivotal rotation of the angular resistance member. The back support member of the bench is of sufficient size to support a human user from knee to head when the bench is in the horizontal position. A support rod having a plurality of apertures along its longitudinal length is attached to the bottom distal end of the back support member. The user can then articulate the back support member toward the seat member of the bench and be supported in a variety of positions by interengaging the support rod and the frame with the use of a pin.

A resistance member is attached to the top distal end of the supporting member proximate to the seat member. The resistance member is comprised of four parts. The first component is a tubular member formed into a right angle. The second component is a T-shaped padded cross piece which interengages with the first right angle member. The third component is an arc having a plurality of radially spaced apertures therein and mounted to the first angular member such that the radius between the pivot point and the apertures is constant. The fourth component of the resistance member is a mechanism with which variable resistance may be attached thereto. The user may fix the position of the resistance member during use by interengaging the arc component and the supporting member with the use of a pin.

In operation, the user can use the equipment in one of three distinct ways. First, the user can sit facing the resistance member and fixedly adjust the back support to a comfortable position. Thereafter, the user works his/her knees into the bottom of the padded cross member of the angular resistance member to isolate exercise upon the lower abdominal muscles. Second, the user, again facing the resistance member, can fix the position of the angular resistance member and using the handles attached to the back support portion of the bench member pivot, his/her torso toward the support member to work his/her upper abdominal muscles. Lastly, the user can integrate these two exercises by allowing the resistance member and back support portion to both move freely thereby simultaneously exercising both the upper and lower abdominal muscles.

A complete understanding of the invention will be obtained from the following description when taken in connection with the accompanying drawing figures wherein like reference characters identify like parts throughout.

BRIEF DESCRIPTION OF THE PREFERRED EMBODIMENTS

Figure 1:
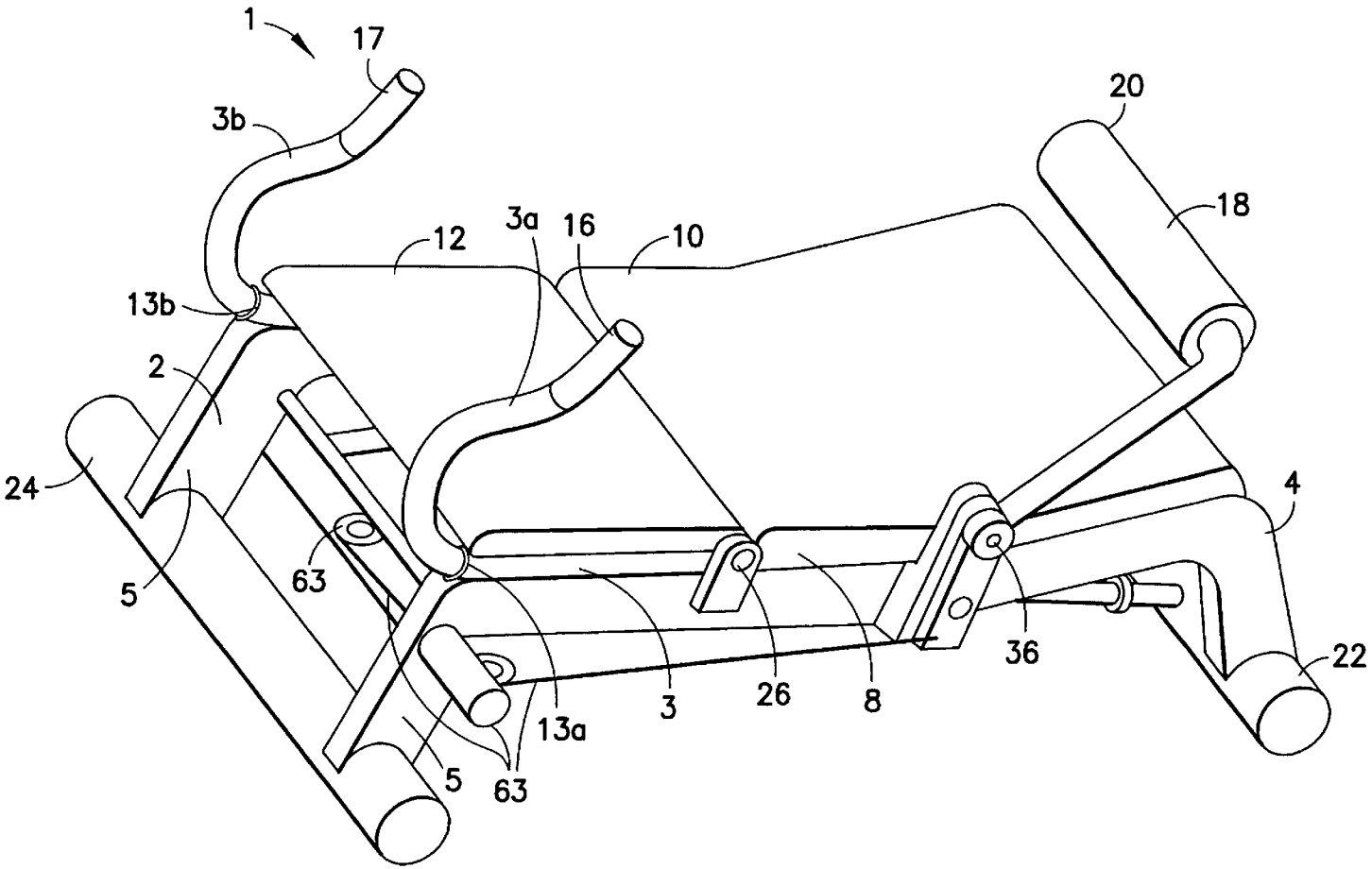
FIG. 1 is a perspective view of the exercise apparatus of the present invention.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
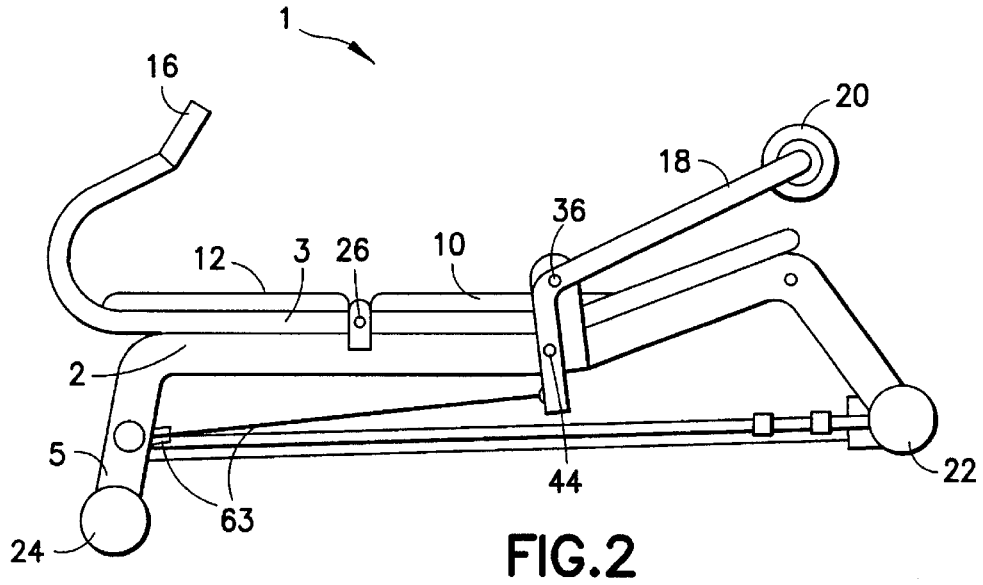
FIG. 2 is a side elevational view of the exercise apparatus shown in FIG. 1.
Figure 3:
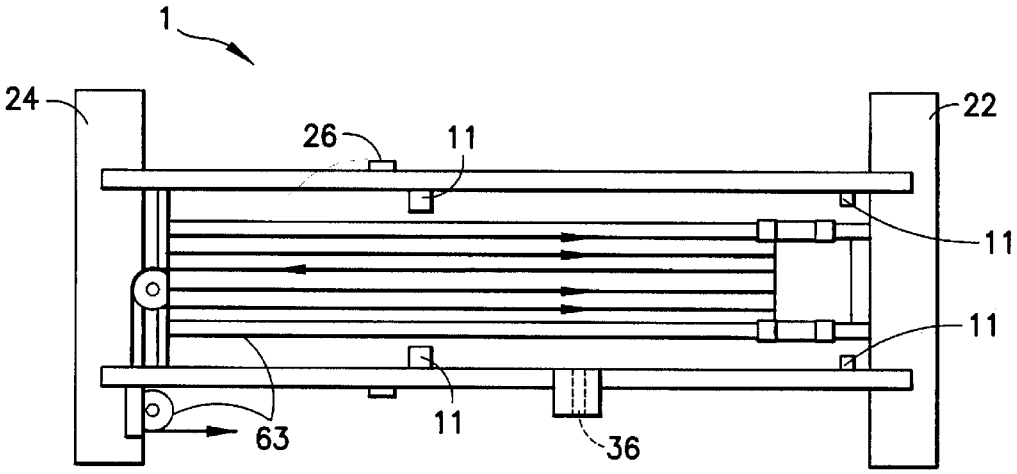
FIG. 3 is a top view of the exercise apparatus depicted in FIG. 2 with the platform removed.
Figure 4:
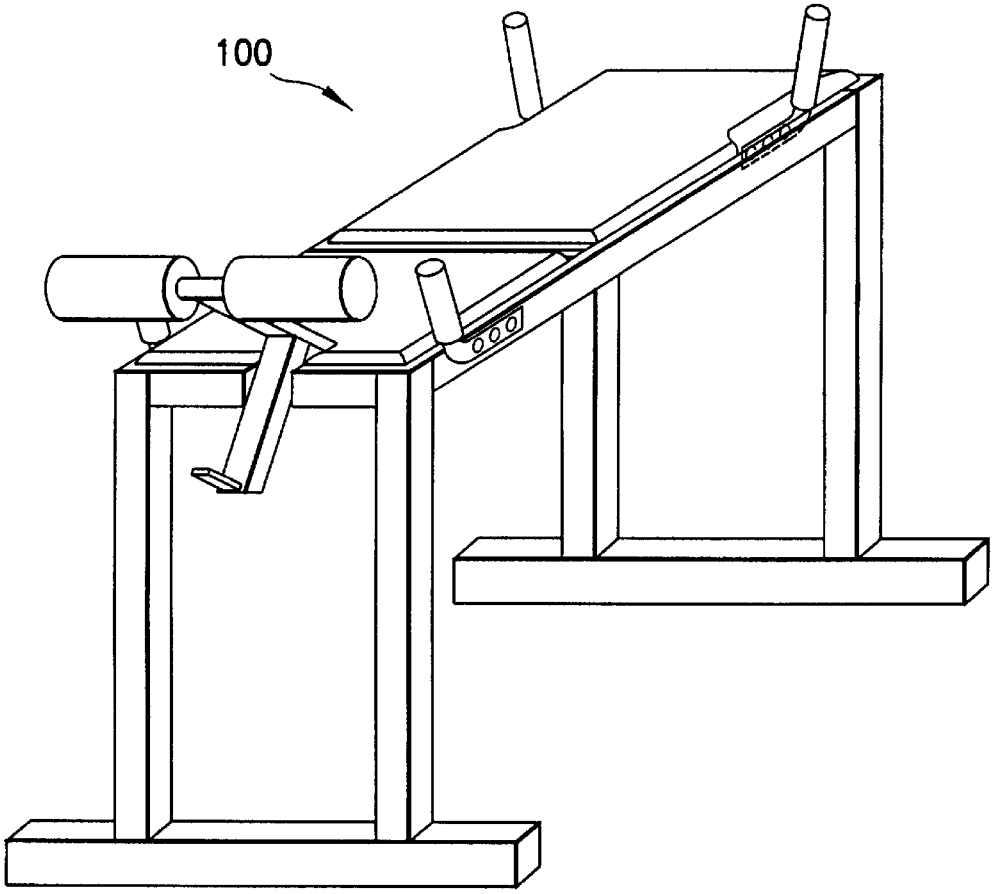
FIG. 4 is a perspective view of an alternate embodiment of the exercise apparatus of the present invention.
Figure 5:
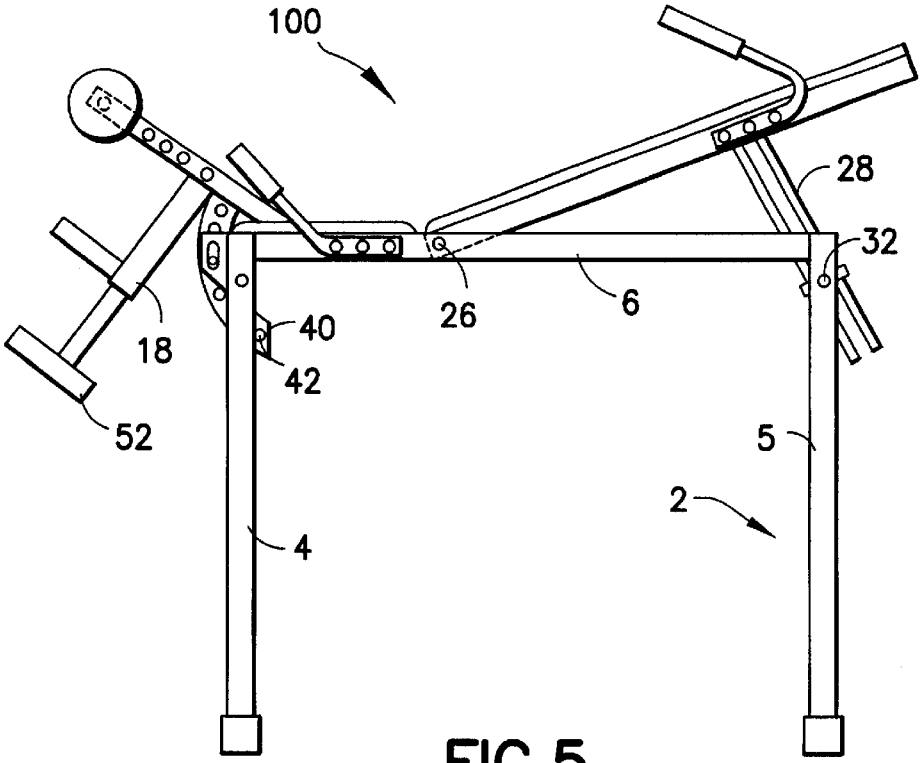
FIG. 5 is a side elevational view of the exercise apparatus depicted in FIG. 4, with the back support portion of the bench in an articulated, slightly elevated fixed position.
Figure 6:
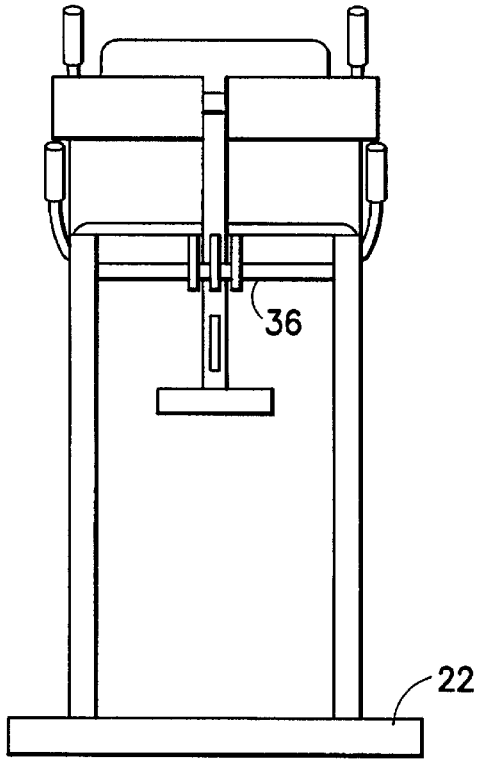
FIG. 6 is a front elevation of the exercise apparatus as depicted in FIG. 5.
Figure 7:
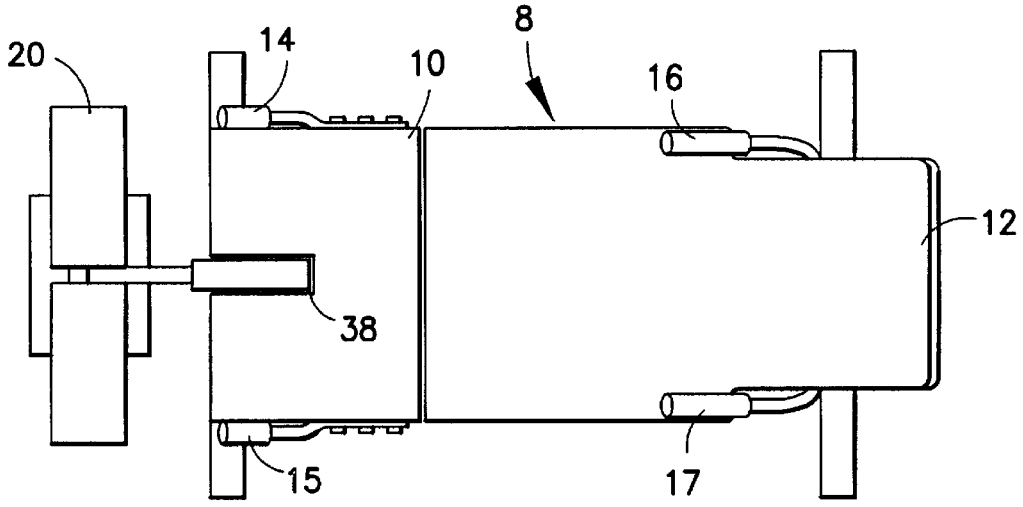
FIG. 7 is a top view of the exercise apparatus depicted in FIG. 5.
Figure 8:
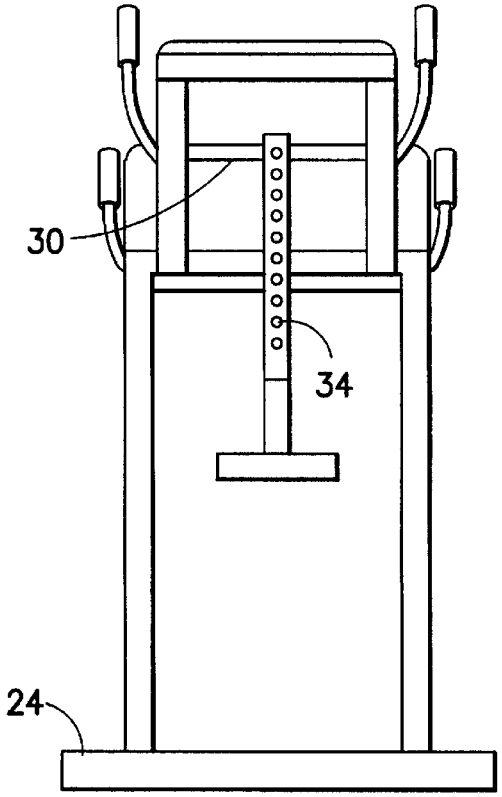
FIG. 8 is a back view of the exercise apparatus depicted in FIG. 5.

FIGS. 1–3 depict exercise equipment according to the present invention, in the form of exercise apparatus 1. Generally, exercise apparatus 1 includes a frame 3 supported by a supporting member 2, a platform 8 for supporting a user, and a resistance member 18 connected to the frame and/or supporting member.

Frame 3 is designed for accommodating the upper torso of a human user during exercise of the abdominal muscles. Frame 3 includes two arm sections 3*a* and 3*b*, which extend along the sides of exercise apparatus 1. Arms 3*a* and 3*b* include handles 16 and 17 and the respective ends thereof. Arms 3*a* and 3*b* are further provided with swivel points 13*a* and 13*b*, respectively. Such swivel points 13*a* and 13*b* permit arms 3*a* and 3*b* to be rotated and swiveled to a lowered position, thus providing exercise apparatus 1 with a lower profile for storage when not in use.

Exercise apparatus 1 further includes resistance member 18 connected to exercise apparatus 1 through supporting member 2. Alternatively, resistance member 18 can be connected to frame 3, as will be discussed in more detail herein with respect to an alternate embodiment of the invention.

Resistance member 18, depicted in the form of a resistance bar, is pivotally connected to supporting member 2 on a latitudinal axis thereof at pivot 36. Pivot 36 permits pivotal rotation of resistance member 18 about such a latitudinal axis. Resistance member 18 may be connected to supporting member 2 at one side thereof, as depicted in FIG. 1, through pivot 36. Alternatively, resistance member 18 may be connected to both sides of supporting member 2, as will be described in more detail with respect to an alternate embodiment of the invention.

Resistance member 18 includes means to vary the resistance of pivotal rotation about the axis provided through pivot 36. Any known method of providing resistance to rotation may be employed in this respect. For example, exercise apparatus 1 may incorporate weights, tensioning members, or cables and pulleys in order to vary the resistance of resistance member 18. In the embodiment depicted in FIGS. 1–3, resistance member 18 is interconnected to a cable and pulley system 63 as means for varying the resistance of pivotal rotation about the rotational axis provided through pivot 36.

Resistance member 18 may further include padded cross member 20, provided for comfort during use. The user rotates resistance member 18 around pivot 36 by exerting force with his/her knees against the padded cross member 20.

With such force exerted by the user's knees in this manner, padded cross member 20 rolls up the front surface of the user's thighs during rotation of resistance member 18 around pivot 36, as is apparent from the arrangement depicted in the Figures.

A locking mechanism 44 may be provided for interengaging resistance member 18 with supporting member 2. Such locking member may include a pin passing through an aperture provided in the arm of resistance member 18 and through a further aperture provided in supporting member 2. In this manner, resistance member 18 can be effectively locked in place to prevent movement thereof, such as during storage of exercise apparatus 1 or during exercise of the upper abdominal muscles during a particular use of exercise apparatus 1.

Platform 8 is further provided for supporting the body of a user. Platform 8 includes a seat portion 10, which is fixedly attached to one end of supporting member 2, for example, through brackets 11. Seat portion 10 is provided at a position adjacent resistance member 18, providing for proper positioning of the user during use. Preferably, seat portion 10 is provided at a slight angle, thereby conforming to the lower back profile of a user.

Platform 8 further includes a back support portion 12, which is attached to the supporting member 2 through frame 3. Back support portion 12 is provided for supporting the upper back of a user during use. Preferably, back support portion 12 is attached to frame 3, and is pivotally connected to supporting member 2 on a latitudinal axis thereof, for example through pivots 26, provided on the sides of supporting member 2. Such pivotal connection allows the user to rotate the back support portion of exercise apparatus 1 during use above horizontal without interference, as will be described in more detail.

Moreover, as with resistance member 18, a locking mechanism 32 may be provided for interengaging back support portion 12 with supporting member 2. Such locking mechanism 32 may include a pin passing through an aperture provided in frame 3, which is attached to back support portion 12, and through a further aperture provided in supporting member 2. In this manner, back support portion 12 can be effectively locked in place to prevent movement thereof, such as during storage of exercise apparatus 1 or during exercise of the lower abdominal muscles during a particular use of exercise apparatus 1.

Supporting member 2 may include any design for providing support to exercise apparatus 1. Preferably, supporting member 2 includes crosspieces 22 and 24, which contact the floor surface upon which exercise apparatus 1 is positioned. Legs 4 and 5 extend between each of crosspieces 22 and 24 and the upper portion of supporting member 2, which supports frame 3. Supporting member 2 may be constructed of any material known in the art to provide such support. Preferably, supporting member 2 is constructed of tubular metal, such as rectangular tubular steel, to provide proper support and strength to exercise apparatus 1.

Figure 11:
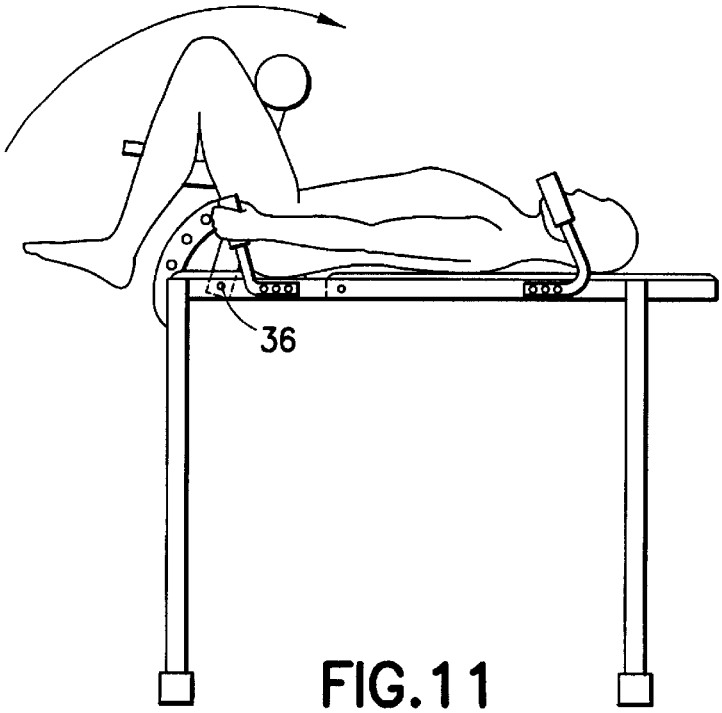
FIG. 11 is a schematic representation of the exercise apparatus of FIG. 4 as used to exercise the lower abdominal muscles.
Figure 12:
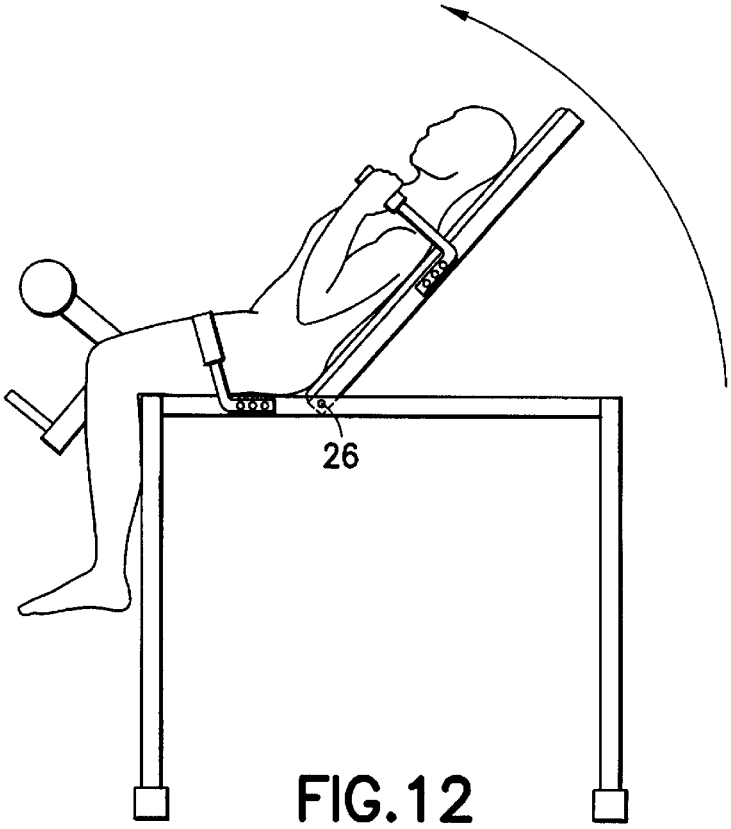
FIG. 12 is a schematic representation of the exercise apparatus of FIG. 4 as used to exercise the upper abdominal muscles.
Figure 13:
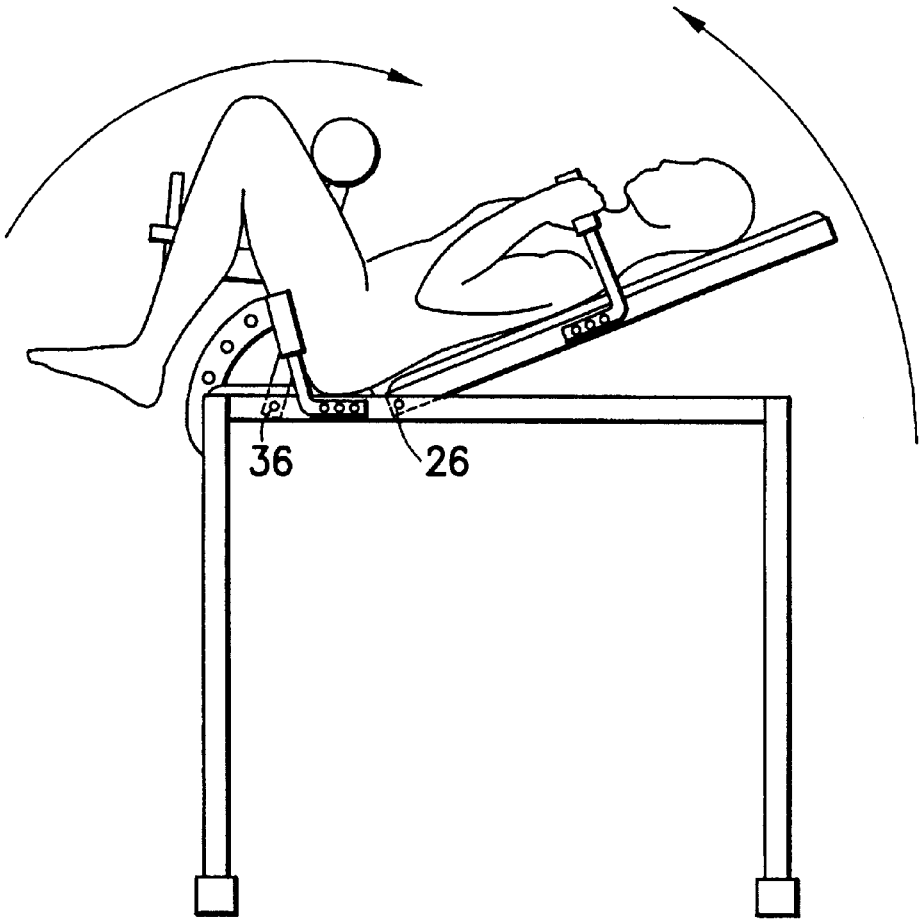
FIG. 13 is a schematic representation of the exercise apparatus of FIG. 4 as used to exercise both the upper and lower abdominal muscles simultaneously.

A slightly modified design is depicted as exercise apparatus 100 in FIGS. 4–8. Such an alternate embodiment also includes a supporting member 2, a platform 8 in the form of a bench, and a resistance member 18 in the form of an angular resistance bar. The user rests on the bench facing the resistance member 18 with his/her knees between the padded cross member 20, as depicted in FIGS. 11–13.

In such an embodiment, the supporting member 2 includes a horizontal section 6, legs 4 and 5, and cross pieces 22 and 24 that provide stability during use.

A seat portion 10 of platform 8 is fixedly attached to the horizontal section 6 of supporting member 2. The back support portion 12 of the platform 8 is pivotally connected to the horizontal section 6 of supporting member 2 using a pivot pin mechanism such as pivot 26. A support rod 28 is pivotally connected to the bottom of the back support portion 12 of platform 8 using a second pivot pin mechanism at pivot 30. Support rod 28 can also be interengaged with horizontal section 6 of supporting member 2 with the use of a locking mechanism 32. Since support rod 28 has a plurality of spaced apertures 34, the back support portion 12 of platform 8 can be articulated by the user into a variety of fixed positions above horizontal.

Resistance member 18 is attached to the horizontal section 6 of supporting member 2 using a third pivot pin at pivot 36. The user rotates resistance member 18 around pivot 36 through slot 38 in seat portion 10 by exerting force with his/her knees against the padded cross member 20.

In such an embodiment, resistance member 18 has an arc 40 having a plurality of spaced apertures 42 at a constant radius from pivot 36. The user can fix the resistance member 18 in a variety of stationary positions above horizontal by interengaging the horizontal section 6 of supporting member 2 with a locking mechanism 44. One set of handles 16 and 17 are attached to the back support portion 12 of bench platform 8. A second set of handles 14 and 15 may be attached to the outside of the horizontal section 6 of supporting member 2. The user can hold either set of handles during exercise for balance or form.

Figure 9:
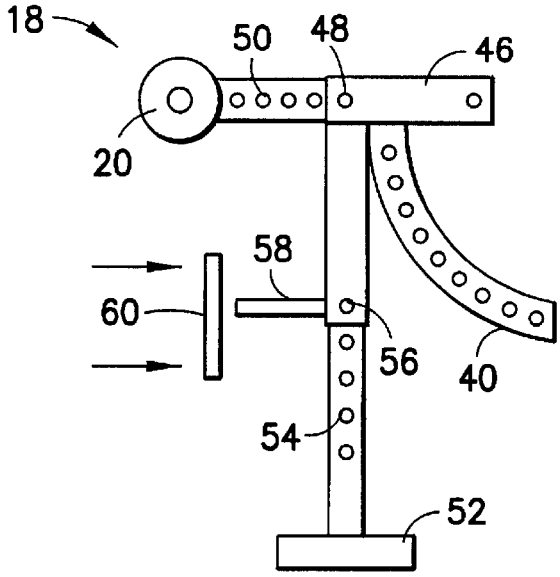
FIG. 9 is an isolated side view of the angular resistance member of the apparatus depicted in FIGS. 5–8.
Figure 10:
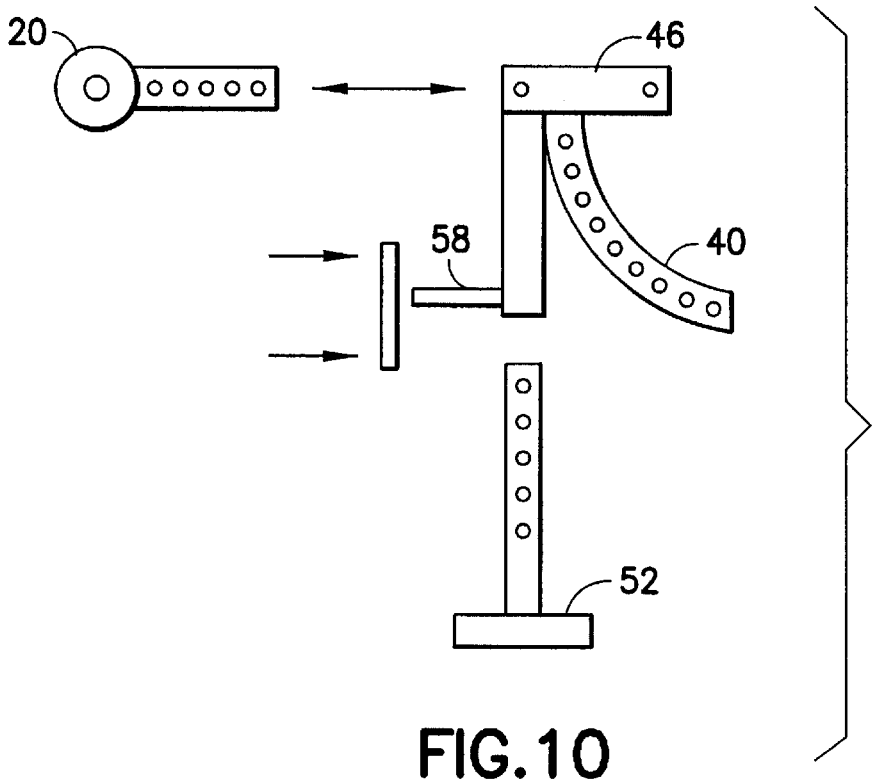
FIG. 10 is an exploded view of the angular resistance member as depicted in FIG. 9.

Referring to FIGS. 9 and 10, padded cross member 20 slidably engages with angular section 46 of resistance member 18. Padded cross member 20 has a plurality of apertures 50 to allow for user adjustment of its length and is fixed in place with a fastening pin 48. A footrest member 52 slidably engages angular section 46 of resistance member 18. Footrest 52 has a plurality of apertures 54 wherein the user can then adjust the position of footrest 52 and fix its position with fastening pin mechanism 56.

A weight pin 58 is attached to angular section 46 of the resistance member 18. Weight pin 58 is of sufficient strength and cross sections so that ordinary weight lifting plates 60, well-known in the art, can be added thereto. Weight pin 58 is oriented so that the weight lifting plates 60 remain thereon even during rigorous use. Alternatively, a fastening means can be used to fix weight lifting plates 60 to weight pin 58. Weight pin 58 can also be used to attach alternative resistance means, such as a pulley system, if the exercise equipment is integrated with other equipment so designed.

The operation of the exercise equipment will be described for each of the three routines for which it can be used. To isolate the exercise exclusively on the lower abdominal muscles, the user fixes the back support portion 12 of platform 8 in the desired position. This is achieved, for example with respect to the embodiment of FIGS. 4–8, by interengaging horizontal section 6 of supporting member 2 and support rod 28 using locking mechanism 32. The user then rests on platform 8 facing the resistance member 18 with his/her knees beneath padded cross member 20. Such a position, with back support portion 12 in its horizontal orientation, is schematically depicted in FIG. 11, with respect to the embodiment depicted in FIGS. 4–8. To execute the exercise, the user holds handles 14 and 15 while exerting effort to bring his/her knees towards his/her chest. Resistance can be varied by adding weight lifting plates 60 to weight pin 58 attached to resistance member 18 for the embodiment depicted in FIGS. 5–8, or through the cable and pulley system with respect to the embodiment depicted in FIGS. 1–3.

To isolate exercise exclusively on the upper abdominal muscles, the user fixes the resistance member 18 into the desired position. This is achieved in the embodiment of FIGS. 1–3 by interengaging resistance member 18 with supporting member 2 with locking mechanism 44, and in the embodiment of FIGS. 4–8 by interengaging the arc section 40 of the resistance member 18 and the horizontal section 6 of supporting member 2 with locking mechanism 44. The user then rests on platform 8 facing the resistance member 18 with his/her knees beneath the padded cross member 20. Such a position, with resistance member 18 elevated slightly above horizontal, is schematically depicted in FIG. 12. To execute the exercise, the user holds handles 16 and 17 while exerting effort to bring his/her chest towards his/her knees.

To exercise both the upper and lower abdominal muscles simultaneously, the user again rests on platform 8 facing the resistance member 18. For this exercise, however, both the resistance member 18 and back support portion 12 of platform 8 are allowed to move freely. To execute the exercise, the user holds handles 16 and 17 and exerts force to bring his/her knees towards his/her chest and vice versa, such that in the fully contracted position both the resistance member 18 and the back support portion 12 are above horizontal. Such a position, with the user fully contracted, is schematically depicted in FIG. 13.

Figure 14:
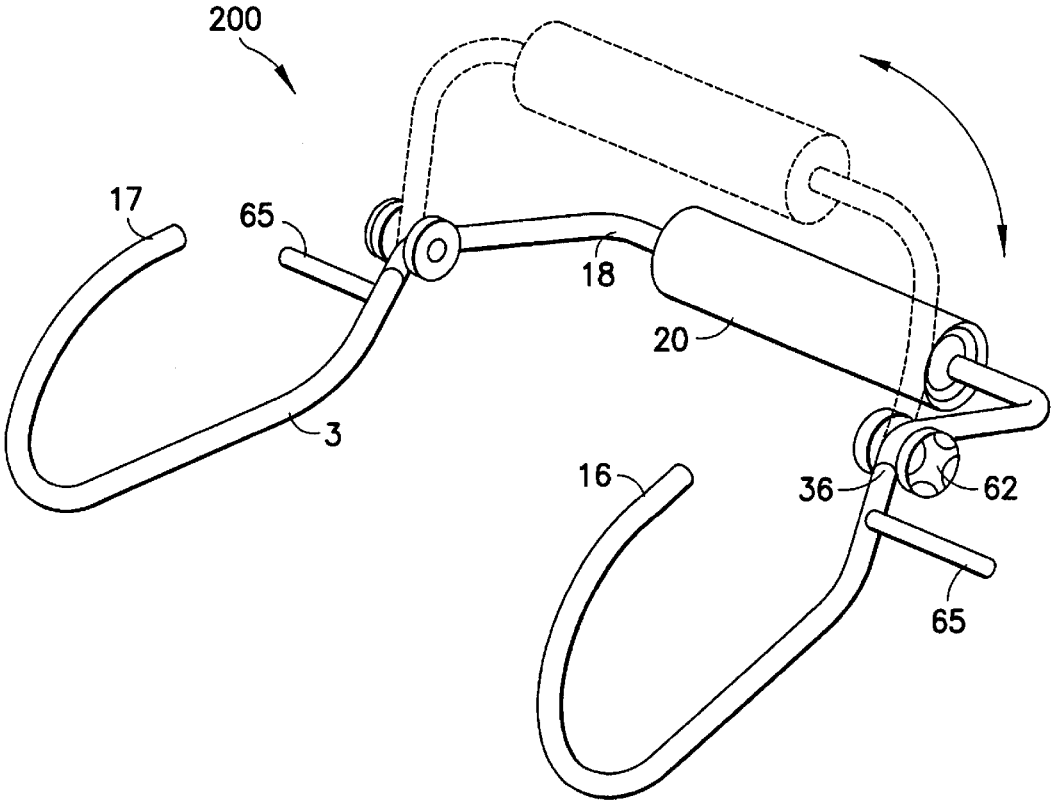
FIG. 14 is an alternate embodiment of the exercise apparatus of the present invention.

In a further embodiment of the present invention, a floor model exercise apparatus is provided, as shown in FIG. 14 as exercise apparatus 200. Such an embodiment incorporates substantially the same arrangement as with the previous discussed embodiments. Exercise apparatus 200, however, is not attached to supporting member 2, but instead includes frame 3 which is positioned directly on the floor. Further, no platform is provided, as the user is supported directly by the floor with exercise apparatus 200 positioned thereabout. In such embodiment, frame 3 accommodates the upper torso of the user. Preferably, resistance member 18 is attached directly to frame 3 at both sides thereof. Further, resistance is preferably provided to resistance member 18 through tensioning members 62, which can adjust the tension through a threaded engagement of pivot 36.

Such an embodiment may further be provided with anchor bars 65, for anchoring exercise apparatus 200 during use. For example, anchoring apparatus may be provided for accommodating ordinary weight lifting plates as well-known in the art to retain exercise apparatus 200 in position during use.

The exercise apparatus 200 is used in a similar manner as described above, with a user rotating resistance member 18 around pivot 36 by exerting force with his/her knees against the padded cross member 20.

While the preferred embodiment of the present invention has been described, it is to be distinctly understood that the invention is not limited thereto, but may be otherwise embodied and practiced within the scope of the following claims.

I claim:

1. An apparatus for exercising the upper and lower abdominal muscles of a human user comprising:

(a) a frame for accommodating the upper torso of said user;

(b) a back support portion pivotally connected to said frame on a latitudinal axis thereto thereby allowing the user to rotate said back support portion above horizontal without interference; and (c) a resistance member pivotally connected to said frame at a location between a first and second end of the frame on a latitudinal axis thereto, said resistance member being pivotally rotatable about said axis, said resistance member having means to vary the resistance of said pivotal rotation, said resistance member in engagement with the knees of the user during use for allowing the knees of the user to raise and lower above horizontal without interference while engaged with said resistance member;

wherein the back support portion and the resistance member are rotatable about their respective axis either independently of each other to independently exercise the upper or lower abdominal muscles or simultaneously with each other to simultaneously exercise the upper and lower abdominal muscles.

2. The apparatus of claim 1, wherein said frame further includes handles for holding by said user.

3. The apparatus of claim 2, wherein said handles are pivotally connected to said frame.

4. The apparatus of claim 1, wherein said frame is supported by a supporting member.

5. The apparatus of claim 4, further comprising a platform for supporting said user attached to said supporting member, said platform having a seat portion fixedly attached to one end of said supporting member at a position adjacent said resistance member, said back support portion attached to said supporting member at a position adjacent said frame.

6. The apparatus of claim 5, wherein said back support portion is attached to said frame and is pivotally connected to said supporting member on a latitudinal axis thereto located immediately adjacent said seat portion of said platform, thereby allowing the user to rotate said back support portion above horizontal without interference.

7. The apparatus of claim 5, wherein said resistance member is pivotally connected to said frame at one side of said supporting member.

8. The apparatus of claim 1, wherein said means to vary the resistance of said pivotal rotation comprises a tensioning member in engagement with said axis.

9. The apparatus of claim 1, wherein said means to vary the resistance of said pivotal rotation comprises a cable and pulley system.

10. An apparatus for exercising the upper and lower abdominal muscles of a human user comprising:

(a) a support member;

(b) a frame supported by said support member at one end thereof, said frame including a back support portion for supporting the upper torso of said user, said back support portion being attached to said frame and being pivotally connected to said support member on a latitudinal axis thereto located immediately adjacent said seat portion, thereby allowing the user to rotate said back support portion above horizontal without interference;

(c) a seat portion fixedly attached to said supporting member at an opposing end thereof; and (d) a resistance member pivotally connected to said support member between a first and second end thereof at a position adjacent said seat portion and on a latitudinal axis to said supporting member, said resistance member pivotally rotatable about said axis, said resistance member having means to vary the resistance of said pivotal rotation, said resistance member in engagement with the knees of a user during use for allowing the knees of the user to raise and lower above horizontal without interference while engaged with said resistance member;

wherein the back support portion and the resistance member are rotatable about their respective axis either independently of each other to independently exercise the upper or lower abdominal muscles or simultaneously with each other to simultaneously exercise the upper and lower abdominal muscles.

11. The apparatus of claim 10, wherein said frame further comprises handles for holding by said user.

12. The apparatus of claim 11, wherein said handles are pivotally connected to said frame.

13. The apparatus of claim 10, wherein said means to vary the resistance of said pivotal rotation comprises a tensioning member in engagement with said axis.

14. The apparatus of claim 10, wherein said means to vary the resistance of said pivotal rotation comprises a cable and pulley system.

15. The apparatus of claim 10, wherein said seat portion includes a slot along the longitudinal axis of said support member through which portions of said resistance member can rotate during raising and lowering of the knees of the user while engaged with said resistance member.

16. The apparatus of claim 10, wherein said resistance member can be interengaged with said support member using a first locking mechanism to prevent said pivotal rotation.

17. The apparatus of claim 16, wherein said locking mechanism is a pin passing through an aperture provided in said support member and an aperture provided in said resistance member.

18. The apparatus of claim 10, wherein said resistance member is pivotally connected to said frame at one side of said supporting member.

19. The apparatus of claim 18, wherein said back support portion includes a supporting rod pivotally connected thereto which can interengage with said support member through a second locking mechanism.

20. The apparatus of claim 19, wherein said second locking mechanism is a pin, said pin passing through an aperture provided in said support member and an aperture provided in said supporting rod.

21. The apparatus of claim 20, wherein said resistance member further includes a slidably engaged footrest fixed in place with a locking mechanism.

* * * * *